US011534010B2

(12) United States Patent
Alexander et al.

(10) Patent No.: US 11,534,010 B2
(45) Date of Patent: Dec. 27, 2022

(54) ADJUSTABLE FRAMING SYSTEM

(71) Applicant: Tracer Imaging LLC, Ossining, NY (US)

(72) Inventors: James Alexander, Mount Kisco, NY (US); Ryan Kelly, Scarsdale, NY (US); Steven M. Spiro, Chappaqua, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 17/517,025

(22) Filed: Nov. 2, 2021

(65) Prior Publication Data

US 2022/0133064 A1 May 5, 2022

Related U.S. Application Data

(60) Provisional application No. 63/108,586, filed on Nov. 2, 2020.

(51) Int. Cl.

| | |
|---|---|
| ***A47G 1/16*** | (2006.01) |
| ***A47G 1/17*** | (2006.01) |
| *A47G 1/24* | (2006.01) |

(52) U.S. Cl.
CPC . *A47G 1/17* (2013.01); *A47G 1/24* (2013.01)

(58) Field of Classification Search
CPC ..... A47G 1/16; A47G 1/1606; A47G 1/1613; A47G 1/162; A47G 1/24; A47G 1/17; F16B 47/003
See application file for complete search history.

(56) References Cited

U.S. PATENT DOCUMENTS

| | | | | |
|---|---|---|---|---|
| 5,353,536 | A | 10/1994 | Erber et al. | |
| 5,605,313 | A * | 2/1997 | Erickson | A47G 1/1606 248/467 |
| 5,781,980 | A | 7/1998 | Golston | |
| 10,856,674 | B2 * | 12/2020 | Wiggins | A47G 1/16 |

(Continued)

OTHER PUBLICATIONS

International Search Report and Written Opinion in PCT Application No. PCT/US2021/057699, dated Feb. 3, 2022.

*Primary Examiner* — Cassandra Davis
(74) *Attorney, Agent, or Firm* — Leason Ellis LLP

(57) ABSTRACT

A frame system according to one embodiment includes a mount body having an inner surface and an opposing outer surface. The outer surface has an adhesive body applied thereto. The adhesive body has an adhesive on an outer surface thereof for contacting and bonding with a support surface. The frame system further includes an outer frame element having a first opening through which an image substrate is visible. The outer frame element has a first surface against which the image substrate seats. A back plate is configured for attachment to the outer frame element and the back plate includes a second opening that receives the adhesive body. The back plate further includes a forward protrusion against which the image substrate seat. A mount space is defined between the outer frame element and the back plate in which the mount body is disposed and is configured to move in at least two directions for adjusting a position of the frame system on the support surface. At least one biasing element (e.g. a spring) applies a force against the mount body for holding the assembled outer frame element and back plate in a desired position relative to the mount body.

17 Claims, 3 Drawing Sheets

(56) References Cited

U.S. PATENT DOCUMENTS

| | | | | |
|---|---|---|---|---|
| 2004/0035039 | A1* | 2/2004 | Bilinszky | B60R 11/00 40/760 |
| 2004/0123503 | A1 | 7/2004 | Pitzen | |
| 2011/0042542 | A1* | 2/2011 | Russo | A47G 1/17 248/467 |
| 2011/0131855 | A1 | 6/2011 | Heeps | |
| 2012/0090211 | A1 | 4/2012 | Price | |
| 2013/0181584 | A1* | 7/2013 | Whitten | F16B 47/003 248/689 |
| 2021/0085103 | A1* | 3/2021 | Voelker | A47G 1/205 |

* cited by examiner

ADJUSTABLE FRAMING SYSTEM

CROSS-REFERENCE TO RELATED PATENT APPLICATIONS

This application is based on and claims priority to U.S. Provisional Patent Application 63/108,586, filed Nov. 2, 2020, the entire contents of which is incorporated by reference herein as if expressly set forth in its respective entirety herein.

TECHNICAL FIELD

The present disclosure is directed to a frame for displaying an object, such as a photograph or artwork, and more particularly, relates to a framing system (frame) or assembly that includes a rear component for fixed attachment to a support surface and a front component that is adjustable relative to the fixed rear component to allow adjustments to be made to the framing system without removal from the support surface.

BACKGROUND

For many years it has been customary to display photographs or other artwork on walls enclosed in picture frames. The design of these frames has virtually remained unchanged, consisting of a wooden molding outer frame with enclosed backer board, upon which a photograph is placed covered in part at the edges with a chipboard mat with bevel cut opening, covered by a pane of glass. A wire line draped from edge to edge on the backside of the frame is then used to hang the frames on a nail/hook or screw imbedded into the wall.

Alternative mounting systems have been commercialized including the use of an adhesive as part of the mounting system. However, one of the challenges of using an adhesive is that it can mar the support surface and also, it is difficult if not impossible to make minor adjustments to the frame position on the support surface. If an adhesive bond is broken with the support surface for the purpose of repositioning of the frame, not only can marring of the support surface occur but also once the adhesive bond is broken, it weakens and reapplication to the support surface results in a weaker bond.

There is therefore a need to provide a framing system that is easy to assembly and also allows for repositioning of the framing system on the support surface without suffering from the deficiencies of the existing frame products.

SUMMARY

A frame system according to one embodiment includes a mount body having an inner surface and an opposing outer surface. The outer surface has an adhesive body applied thereto. The adhesive body has an adhesive on an outer surface thereof for contacting and bonding with a support surface. The frame system further includes an outer frame element having a first opening through which an image substrate is visible. The outer frame element has a first surface against which the image substrate seats. A back plate is configured for attachment to the outer frame element and the back plate includes a second opening that receives the adhesive body. The back plate further includes a forward protrusion against which the image substrate seat. A mount space is defined between the outer frame element and the back plate in which the mount body is disposed and is configured to move in at least two directions for adjusting a position of the frame system on the support surface. At least one biasing element (e.g. a spring) applies a force against the mount body for holding the assembled outer frame element and back plate in a desired position relative to the mount body.

BRIEF DESCRIPTION OF THE DRAWING FIGURES

DETAILED DESCRIPTION OF CERTAIN EMBODIMENTS

Adjustable Framing System 100 (FIGS. 1-6)

Figure 1:
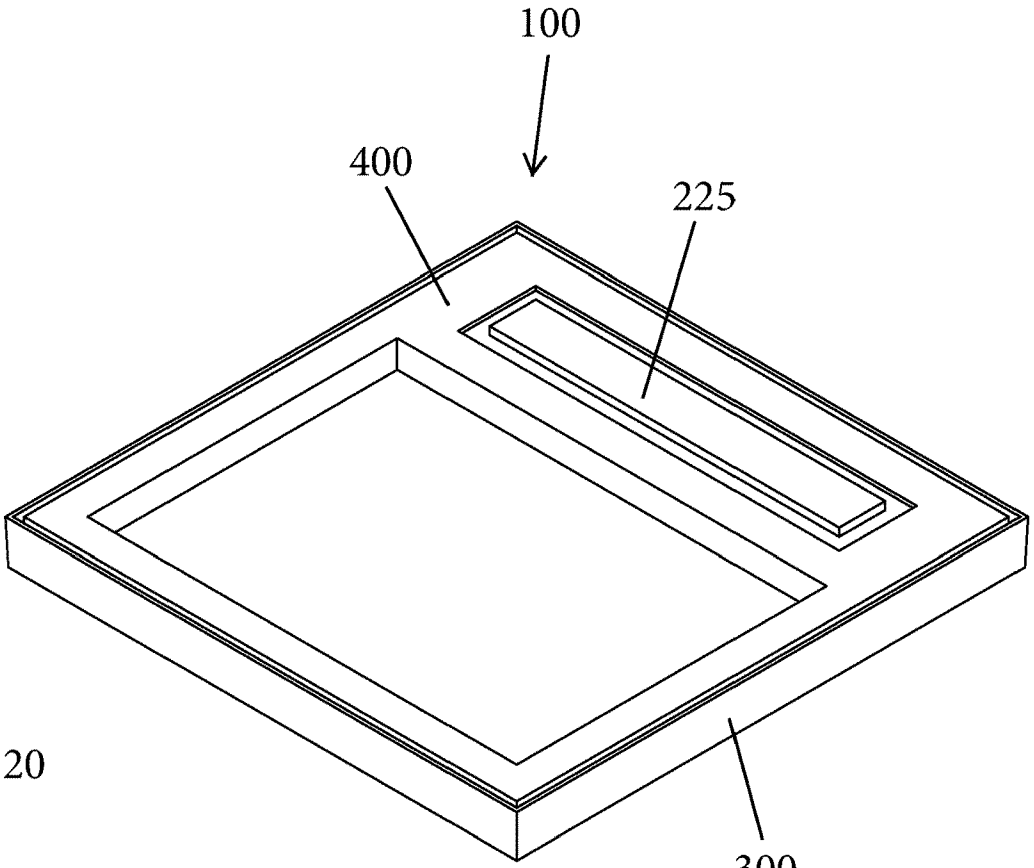
FIG. 1 is a view of an adjustable framing system according to a first embodiment.
Figure 2:
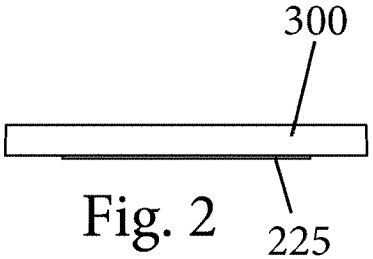
FIG. 2 is a side elevation view thereof.
Figure 4:
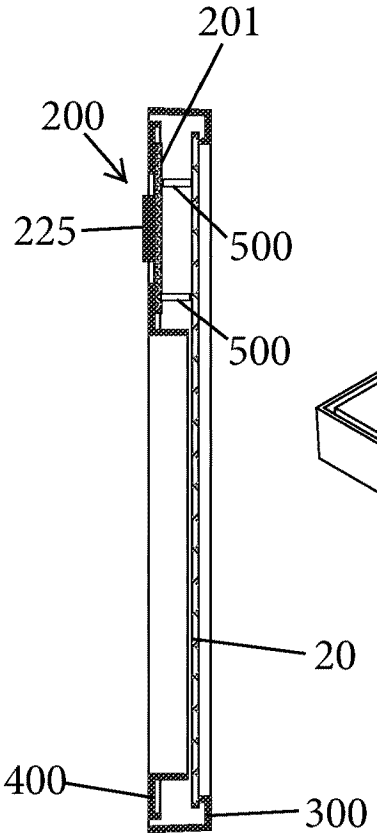
FIG. 4 is a cross-sectional view taken along the line A-A of FIG. 3.
Figure 3:
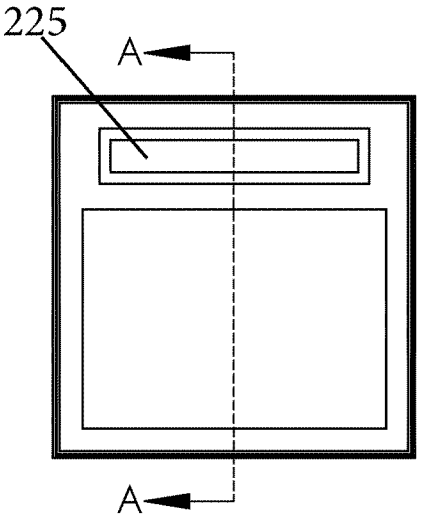
FIG. 3 is a rear elevation view thereof.

In accordance with the present disclosure, as illustrated in FIGS. 1-6, a framing system or assembly (kit) 100 is shown and described and is configured to create a framed article that can be displayed either on a support surface, such as a wall. The framed article is configured to display an image that is part of an image substrate 20 that is held and displayed within the framing system 100. The image substrate 20 is typically a rigid substrate on which an image is displayed. While the image substrate 20 is illustrated in the figures as a single layer, it will be appreciated that the image substrate 20 can include more than one layer, such as a rigid backing layer and a photo layer or the like. The image displayed can take any number of different forms including a paper clipping, a photo, artwork including a painting on canvas, or other artistic expression.

As described herein, the framing system 100 provides an easy to use and easy to assemble kit that allows a user to assemble the frame and position and retain the image substrate 20 therein.

The framing system 100 has two main parts, namely, a mount 200 that is configured to be fixedly attached to the support surface and a frame subassembly that is formed of an outer frame element 300 and a back plate 400 that mates with the outer frame element 300 to form the assembled frame. As described herein, the outer frame element 300 and the back plate 400 are attached to one another with a mechanical fit and more particularly, can snap-fittingly mate with one another.

Mount 200

The mount 200 is constructed and intended to be fixedly attached to the support surface (wall), while allowing the frame subassembly to be adjustable coupled to the mount 200. As described herein, this arrangement allows for the frame subassembly to be adjusted, in a rotational direction, while the entire framed article is mounted to the support surface. In other words, the framed article does not have to be taken down in order to make (rotational) adjustments.

The mount 200 has a body 201 that has an inner surface 212 and an outer surface 214. The mount 200. In the illustrated embodiment, the mount 200 is an elongated member and more specifically, the mount 200 can have a rectangular shape. In the illustrated embodiment, the body 201 of the mount 200 has a top edge 202, an opposite bottom edge 204, a first end 206, and an opposite second end 208. When assembled into the frame subassembly, the top edge 202 faces towards the top of the framed article, the bottom edge 204 faces towards the bottom of the frame article, the first end 206 faces towards one side of the framed article, and the second end 208 faces towards the other side of the framed article.

The outer surface 214 of the mount 200 includes an adhesive pad 225, such as a double-sided adhesive pad that is bonded to the outer surface 214 along an inner surface of the adhesive pad. The outer surface of the adhesive pad 225 can include a release layer that is removed to reveal an adhesive layer, such as a permanent adhesive layer. The mount 200 is attached to the support surface by pressing the adhesive layer onto the support surface.

The shape of the adhesive pad 225 is complementary to the shape of the mount 200 and therefore, in the illustrated embodiment, the adhesive pad 225 has a rectangular shape. In the illustrated embodiment, the footprint of the adhesive pad 225 is less than the footprint of the mount 200.

Outer Frame Element 300

The outer frame element 300 is a hollow piece that has a main body that defines a hollow center opening 305. The outer frame element 300 can have any number of different shapes and sizes based on the intended shape and size of the framed article. The main body of the outer frame element 300 has a plurality of (e.g., four) interconnected walls 302, 304, 306, 308. The illustrated main body has a square shape and therefore, each of the interconnected walls 302, 304, 306, 308 can be in the form of a rail or the like. Each of the walls 302, 304, 306, 308 has an outer surface and an inner surface. The illustrated outer surface represents the portion of the frame system 100 that is readily visible and therefore, it can be smooth or it can have a decorative finish (and thus is not limited to being a smooth surface).

Figure 6:
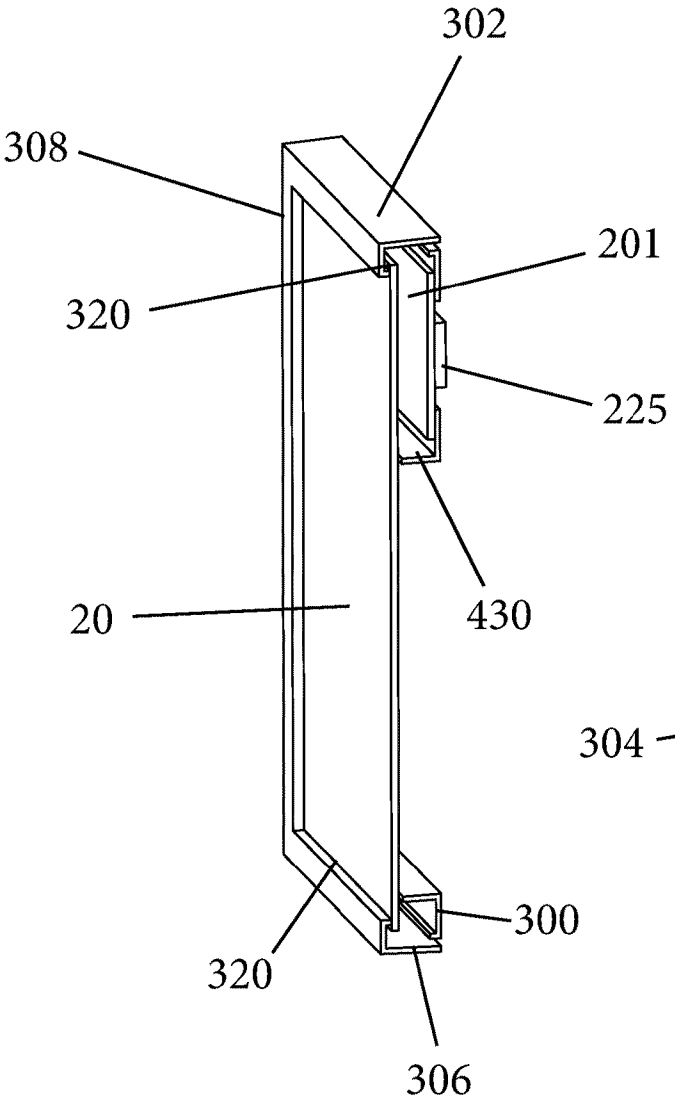
FIG. 6 is a first cross-sectional view.

As shown in FIG. 6, the outer frame element 300 can include an inwardly directed lip 320 along the front of the outer frame element 300. This lip 320 defines a surface against which the image substrate 20 seats when the frame assembly 100 is fully assembled.

The outer frame element 300 can be formed of any number of suitable materials including suitable plastics (e.g., injection molded plastics).

Back Plate 400

The back plate 400 serves as the rear part of the frame assembly 100 that is located behind the image substrate 20 and the engagement of the back plate 400 to the outer frame element 300 serves to capture and hold the image substrate 20 between the back plate 400 and the outer frame element 300.

Figure 5:
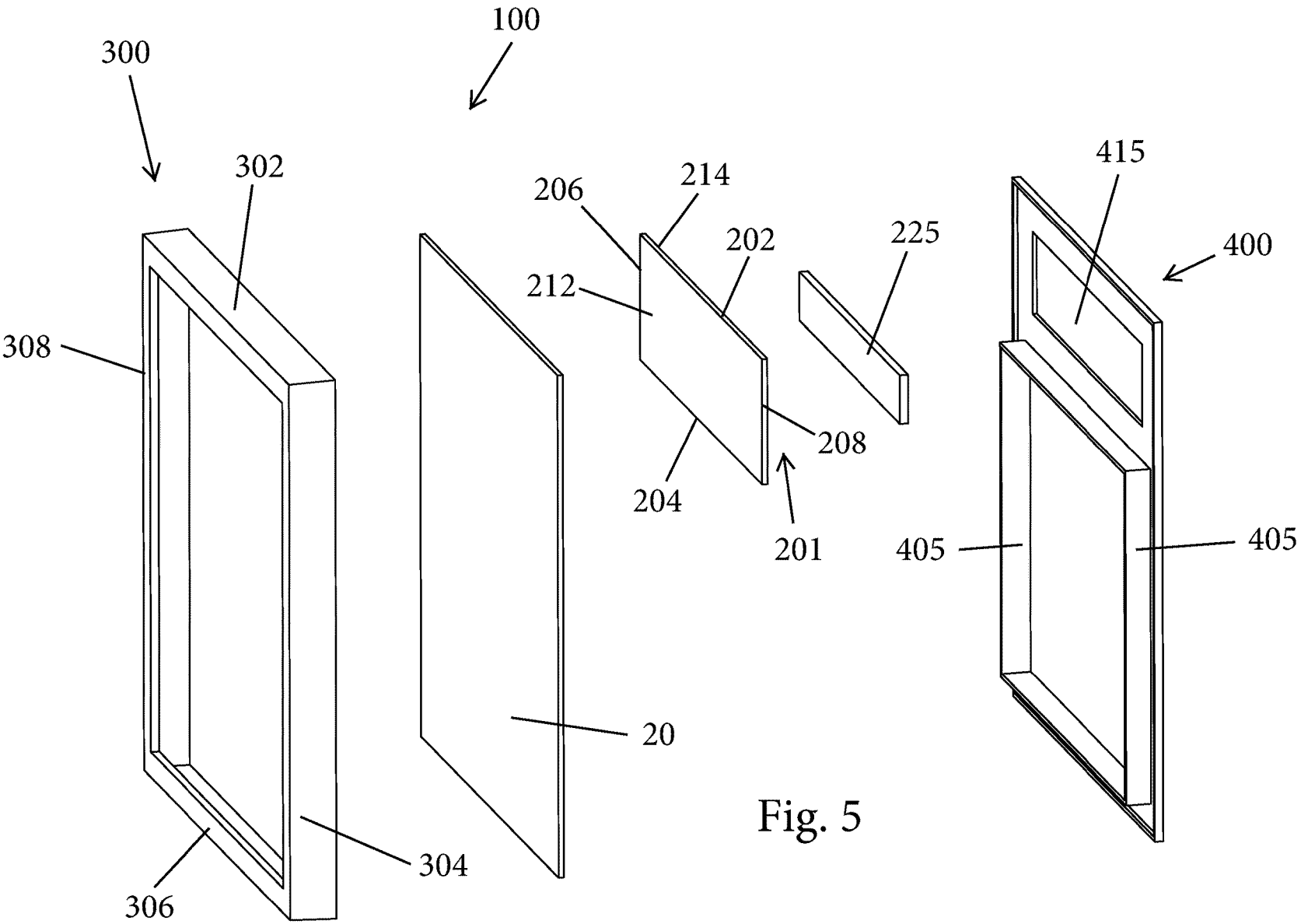
FIG. 5 is an exploded perspective view thereof.
Figure 7:
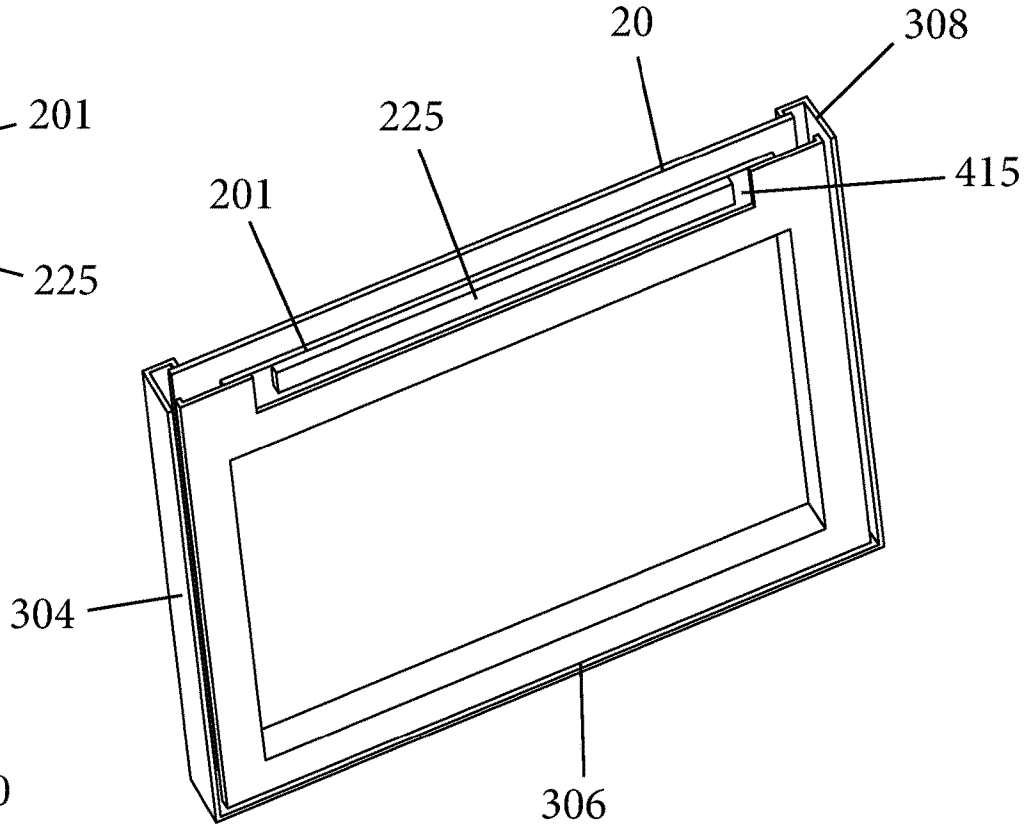
FIG. 7 is a second cross-sectional view.

As mentioned, the back plate 400 attaches to the outer frame element 300 and closes off the back of the frame system 100. As also described herein, the image substrate 20 is disposed and held between the back plate 400 and the outer frame element 300. The back plate 400 includes a forward protrusion 405 that serves to contact the image substrate 20 and more particularly, the image substrate 20 can be held between the forward protrusion 405 and the lip 320 of the outer frame element 300. The forward protrusion 405 thus provides a surface against which the image substrate 20 seats. In the illustrated embodiment, the forward protrusion 405 has a square shape defined by four rails with a hollow space therebetween. As shown in FIG. 5, the forward protrusion 405 occupies a bottom region of the back plate 400 and in the illustrated embodiment, the forward protrusion 405 occupies more than a majority of the footprint of the back plate 400.

A mount space 430 is formed a top wall of the forward protrusion 405 and the wall 302. A bottom of the mount space 430 is defined by the top wall of the forward protrusion 405, the top of the mount space 430 is defined by the wall 302, a first end of the mount space 430 is defined the wall 304 and the opposite second end of the mount space 430 is defined by the wall 308. As described herein, the mount 200 is received within the mount space 430.

An upper region of the back plate 400 includes an opening 415. The opening 415 is sized and shaped to receive the adhesive pad 225 to allow the adhesive pad 225 to extend rearward to the back plate 400 and into contact with the support surface (wall). The adhesive pad 225 is thus fixedly attached to the support surface and since the adhesive pad 225 is fixedly attached to the body 201 of the mount 200, the body 201 of the mount 200 is likewise fixedly attached to the support surface. As described herein, the oversized nature of the mount space 430 relative to the mount 200 allows for adjustment of the frame subassembly by moving the frame subassembly relative to the fixed mount 200. The mount space 430 must be sized to allow for the up and down movement of the back plate 400 relative to the body 201 as well as left and right movement. Moreover, the opening 415 must also be sized to allow for this up, down, left and right movement of the back plate 400 relative to the adhesive pad 225. These arrangements allow for adjustments of the frame subassembly after it is mounted to the mount 200 as described herein.

Biasing Element 500

The frame system 100 also includes a biasing element 500 that is configured to apply a biasing force in rear direction toward the support surface (wall). More specifically, the biasing element 500 is designed to apply a force against a front (surface) face of the body 201 of the mount 200 so that the body 201 is pressed against the front surface of the back plate 400.

The biasing element 500 can take the form of one or more springs that are disposed between a first surface and the inner surface 212 of the mount 200. The first surface can be a rear face of the image substrate 20 or can be a face of the outer frame element 300.

The function of the biasing element 500 is to apply a force to the body 201 so that the body 201 seats against the back plate 400. In this way, the frame subassembly 300, 20, 400 is coupled to the mount 200 and can maintain a position that is set by the user, while permitting the user to make up/down and left/right adjustments of the frame subassembly 300, 20, 400 relative to the mount 200. In other words, the force applied by the biasing element(s) to the mount body 201 causes the frame subassembly to remain in place against the fixed mount 200. The force of the biasing element 500 seats the frame subassembly against the mount 200 such that the frame subassembly does not freely move relative to the mount 200.

The biasing element 500 can thus be in the form of one or more separate springs that are disposed in the mount space 430 or the biasing element can be integrally formed with the mount body 201. In other words, the body 201 can include one or more integral spring members that contact the first surface (e.g., the image substrate 20 or the outer frame element 300) and push forward the mount body 201 against the back plate 400.

The back plate 400 can be formed of any number of suitable materials including suitable plastics (e.g., injection molded plastics). As shown, the back plate 400 is preferably an integral single piece structure.

Mounting Process

First the mount 200 is secured to the support surface by removing the release cover and then pressing the exposed adhesive pad 225 against the support surface resulting in the mount 200 being fixedly attached to the support surface. The back plate 400 is then positioned relative to the fixed mount 200 by orienting it such that the adhesive pad 225 passes through the opening 415 formed in the back plate 400. The mount body 201 is located forward of the opening 415 within the upper region of the back plate 400.

The back plate 400 is designed to snap fit with the outer frame element 300 with the mount 200 being located with the mount space 430 that is formed when the outer frame element 300 and the back plate 400 are attached to one another. The biasing element(s) 500 apply the rearward force against the mount body 201 so that the mount body 201 itself seats against the back plate 400 thereby holding and maintaining the position of the frame subassembly relative to the fixed mount 200.

Adjusting the Framing System

In accordance with the present disclosure, the framing system 100 is designed so that it can be incrementally adjusted in the up direction, down direction, left direction and right direction relative to the fixed mount 200. In particular, the height of the mount space 430 defines the degree of up and down movement of the back plate 400 relative to the fixed mount 200 and similarly, the width of the mount space 430 defines the degree of left and right movement of the back plate 400 relative to the fixed mount 200. As mentioned, the wall 302 defines the maximum lowered adjustment position of the frame subassembly relative to the fixed mount 200 in that the wall 302 acts as a stop when the top edge of the mount body 201 contacts the wall 302. The top wall of the forward protrusion 405 defines the maximum raised adjustment position of the frame subassembly relative to the fixed mount 200 in that the top wall of the forward protrusion 405 acts as a stop when the bottom edge of the mount body 201 contact this top wall. The wall 304 defines the maximum right adjustment position of the frame subassembly relative to the fixed mount 200 in that the wall 304 acts as a stop when the right edge of the mount body 201 contact this wall 304. The wall 308 defines the maximum left adjustment position of the frame subassembly relative to the fixed mount 200 in that the wall 308 acts as a stop when the right edge of the mount body 201 contact this wall 308.

The biasing element 500 continues to apply a biasing force to the mount body 201 as the frame subassembly is adjusted relative to the mount 200. As a result of this biasing force, the adjustment is a smooth process and the frame subassembly does not slip and maintains the new repositioned position due to the biasing force pressing the mount body 201 against the back plate 400.

The ability for the frame subassembly to move relative to the fixed mount 200 allows the user to make small adjustments of the framed article in one or more of the following directions: up direction, down direction, left direction and right direction. It will also be appreciated that the frame subassembly can be slightly rotated in order to adjust it as well. Thus, the present system allows for one or more of axial adjustment (in multiple directions) and rotational adjustment (in different directions). This capability allows for the framed article to be properly positioned on the support surface including positioning of the framed article relative to other framed articles. The user simply grasps the outer frame element 300 and moves the frame article in the desired direction (e.g., up, down, left or right) and once the desired repositioned location is reached, the user releases the grasp on the outer frame element 300. The force applied by the biasing element maintains the framed article in the desired repositioned location.

It will be appreciated that as the frame subassembly 300, 20, 400 moves relative to the fixed mount 200, the at least one biasing element 500 accommodates such sliding action. For example, in some embodiments, the at least one biasing element 500 can slide relative to one or more of: (1) the image substrate or outer frame element and (2) the mount body 201.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A frame system comprising:

a mount body having an inner surface and an opposing outer surface, the outer surface having an adhesive body applied thereto, the adhesive body having an adhesive on an outer surface thereof for contacting and bonding with a support surface;

an outer frame element having a first opening through which an image substrate is visible, the outer frame element having a first surface against which the image substrate seats;

a back plate configured for attachment to the outer frame element, the back plate including a second opening that receives the adhesive body, the back plate further includes a forward protrusion against which the image substrate seat; and a mount space that is defined between the outer frame element and the back plate in which the mount body is disposed and is configured to move in at least two directions for adjusting a position of the frame system on the support surface; and at least one biasing element applying a force against the mount body for holding the assembled outer frame element and back plate in a desired position relative to the mount body.

2. The frame system of claim 1, wherein the outer frame element and the back plate are coupled by a snap-fit.

3. The frame system of claim 1, wherein the first surface comprises an inwardly directed peripheral lip.

4. The frame system of claim 1, wherein the forward protrusion is square shaped and is located below the second opening and defines a surface against which a rear surface of the image substrate seats.

5. The frame system of claim 4, wherein the mount body is located above a top wall of the forward protrusion and the top wall defines a bottom of the mount space.

6. The frame system of claim 5, wherein a top of the mount space is defined by a top wall of the outer frame element, a first end of the mount space is defined by a first side wall of the outer frame element and an opposite second end of the mount space is defined by a second side wall of the outer frame element.

7. The frame system of claim 1, wherein a first ratio is equal to a width of the mount space relative to a width of the mount body; a second ratio is equal to a height of the mount space relative to a height of the mount body, a third ratio is equal to a height of the second opening relative to a height of the adhesive body and a fourth ratio is equal to a width of the second opening relative a width of the adhesive body, wherein the first ratio is equal to or greater than the fourth ratio and the second ratio is equal to or greater than the third ratio.

8. The frame system of claim 1, wherein an area of the second opening is greater than an area of the adhesive body.

9. The frame system of claim 1, wherein a footprint of the adhesive body is less than a footprint of the mount body.

10. The frame system of claim 1, wherein the at least two directions include a top and down direction and a left and right direction.

11. The frame system of claim 1, wherein a height of the mount space is greater than a height of the mount body and a width of the mount space is greater than a width of the mount body.

12. The frame system of claim 1, wherein the at least one biasing element comprises at least one spring that is disposed between and seats against one of the image substrate and the outer frame element and the mount body.

13. The frame system of claim 12, wherein there are a pair of springs.

14. The frame system of claim 12, wherein the at least one spring seats at a first end thereof against the image substrate and seats at a second end thereof against the mount body.

15. The frame system of claim 1, wherein the at least one biasing element comprises a spring element that is integrally formed as part of the mount body.

16. The frame system of claim 1, wherein the adhesive body comprises an adhesive pad with a removable release cover.

17. The frame system of claim 1, wherein the at least one biasing element urges the mount body flush against the back plate.

* * * * *